US005735000A

United States Patent [19]

Pfaeffle

[11] Patent Number: 5,735,000

[45] Date of Patent: Apr. 7, 1998

[54] INFANT BATHING APPARATUS WITH FAUCET GUARD

[76] Inventor: Patricia Pfaeffle, 72 S. Charles St., Hopelawn, N.J. 08861

[21] Appl. No.: 661,907

[22] Filed: Jun. 12, 1996

[51] Int. Cl.[6] ..... A47K 3/024

[52] U.S. Cl. ..... 4/572.1; 4/571.1; 4/585; 4/586

[58] Field of Search ..... 4/572.1, 571.1, 4/585, 586, 588, 655, 657, 580, DIG. 18, 506, 581, 582, 583; 5/461; 428/315.5, 315.7, 315.9; 2/68, 421, 425, 410, 411

[56] References Cited

U.S. PATENT DOCUMENTS

| | | | |
|---|---|---|---|
| 1,406,147 | 2/1922 | Brady | 4/655 |
| 2,112,409 | 3/1938 | Prince | 4/588 |
| 2,806,227 | 9/1957 | Arbetter | 4/657 |
| 3,931,652 | 1/1976 | Navarra . | |
| 4,216,552 | 8/1980 | Gurolnick . | |
| 4,675,213 | 6/1987 | Yammamori et al. | 427/244 |
| 4,838,967 | 6/1989 | Todd et al. . | |
| 5,040,252 | 8/1991 | Taggart | 4/580 |
| 5,065,752 | 11/1991 | Sessions et al. | 128/156 |
| 5,189,743 | 3/1993 | Difloe | 5/724 |
| 5,345,622 | 9/1994 | Plone . | |

FOREIGN PATENT DOCUMENTS

| | | | |
|---|---|---|---|
| 3134256 | 5/1995 | Germany | 4/580 |
| 12215 | of 1899 | United Kingdom | 4/657 |

*Primary Examiner*—David J. Walczak
*Attorney, Agent, or Firm*—Cobrin, Gittes & Samuel

[57] ABSTRACT

An infant bathing apparatus including a cushioned body having a cavity surrounded on all sides except one by the body. The sides and bottom of the cushioned body are formed from a water permeable outer layer joined to a water permeable inner layer having a hydrophobic material disposed therebetween.

19 Claims, 4 Drawing Sheets

INFANT BATHING APPARATUS WITH FAUCET GUARD

BACKGROUND OF THE INVENTION

This invention relates generally to bathing tubs for infants and more particularly to an infant bathing spa with a faucet guard.

It is known in the art to bathe infants in bathing tubs that fit into sinks or bathing tubs that sit in a standard bath tub. More particularly, there are inflatable infant bathing tubs which form fit into kitchen sinks, there are inflatable infant bathing tubs that include frame structures and there are sculptured infant bathing tubs. Examples of such devices are set forth in the following patents:

| U.S. Pat. No. | Inventor |
|---|---|
| 3,931,652 | Navarra |
| 4,216,552 | Gurolnick |
| 4,838,967 | Todd et al. |
| 5,345,622 | Plone |

U.S. Pat. No. 3,931,652 to Navarra discloses an infant bathing apparatus.

U.S. Pat. No. 4,216,552 to Gurolnick discloses a sink mounted infant bathing device.

U.S. Pat. No. 4,838,967 to Todd et al. discloses an inflatable baby's bath.

U.S. Pat. No. 5,345,622 to Plone discloses a method of fabricating inflatable bathing tubs and associated support apparatus.

Conventional infant bathing tubs have either been constructed of relatively rigid materials such as stiff plastics or metal or have been constructed from soft plastics to be inflatable. As is well known, babies in their first few months of life are very delicate and must be handled with great care to avoid bodily harm. The use of a bath made of rigid material could cause damage to the baby if the baby slipped from the hands of the person washing it. It is also well known that tubs of this nature take a lot of abuse during storage or transport. The inflatable tubs may pop due to such abuse. Further, when storing these items, the inflatable tubs may become moldy or mildew because they are difficult to dry completely. Conventional baby tubs are also generally not versatile. They are either made for new born infants or for older babies. This forces parents to buy multiple tubs during the infancy of the child. Lastly, conventional infant tubs provide no protection to the infant from the water faucet or from the knobs.

Thus there exists the need for a versatile device for washing infants (newborn and older babies) which is soft enough to protect the infant from harm, yet durable enough not to break or pop.

It is accordingly an object of the present invention to provide a baby spa that is both soft and durable.

It is another object of the invention to provide a baby spa which is mold and mildew resistant.

It is a further object of the invention to provide a baby spa that can be used to wash infants of all ages until they are able to be washed in a regular bath tub.

It is still a further object of the invention to provide an apparatus for bathing an infant that can be used in a sink or in a bath tub and which protects a baby from getting burned by the hot water faucet.

SUMMARY OF THE INVENTION

The foregoing objects are attained by the present invention, which provides a baby spa that is soft yet durable.

The invention utilizes a cushioned body having a cavity wherein the cavity is surrounded on all sides except one by the body. The cushioned body includes a water permeable outer layer sealed to a water permeable inner layer and a hydrophobic material disposed between the outer and inner layers.

In one embodiment of the invention, the bathing apparatus is generally trough shaped and may be used in a kitchen sink. The bathing apparatus includes a number of generally tubular shaped, water permeable, side walls wherein each of the side walls has a top and a bottom. It further includes a water permeable floor joined to the bottom of each of the side walls. The floor includes an outer layer and an inner layer each layer having a number of edges such that the outer layer is joined to the inner layer at the edges of the layers. The walls and the floor are each filled with a hydrophobic material. Thus the combination of the outer layer of the floor, the inner layer of the floor and the hydrophobic material form a water permeable cushion. The combination of the generally tubular walls and the hydrophobic material also form water permeable cushions.

The invention will next be described in connection with certain illustrated embodiments; however, it should be clear to those skilled in the art that various modifications, additions and subtractions can be made without departing from the spirit or scope of the claims.

BRIEF DESCRIPTION OF THE DRAWINGS

For a fuller understanding of the nature and objects of the invention, reference should be made to the following detailed description and accompanying drawings, in which.

DESCRIPTION OF ILLUSTRATED EMBODIMENTS

The invention is directed to an infant bathing apparatus with faucet guard. This bathing apparatus can be used to bathe a child from infancy until the child is old enough to be bathed in a regular tub. It is portable and can be used at home, in hospitals or when traveling with an infant.

Figure 1:
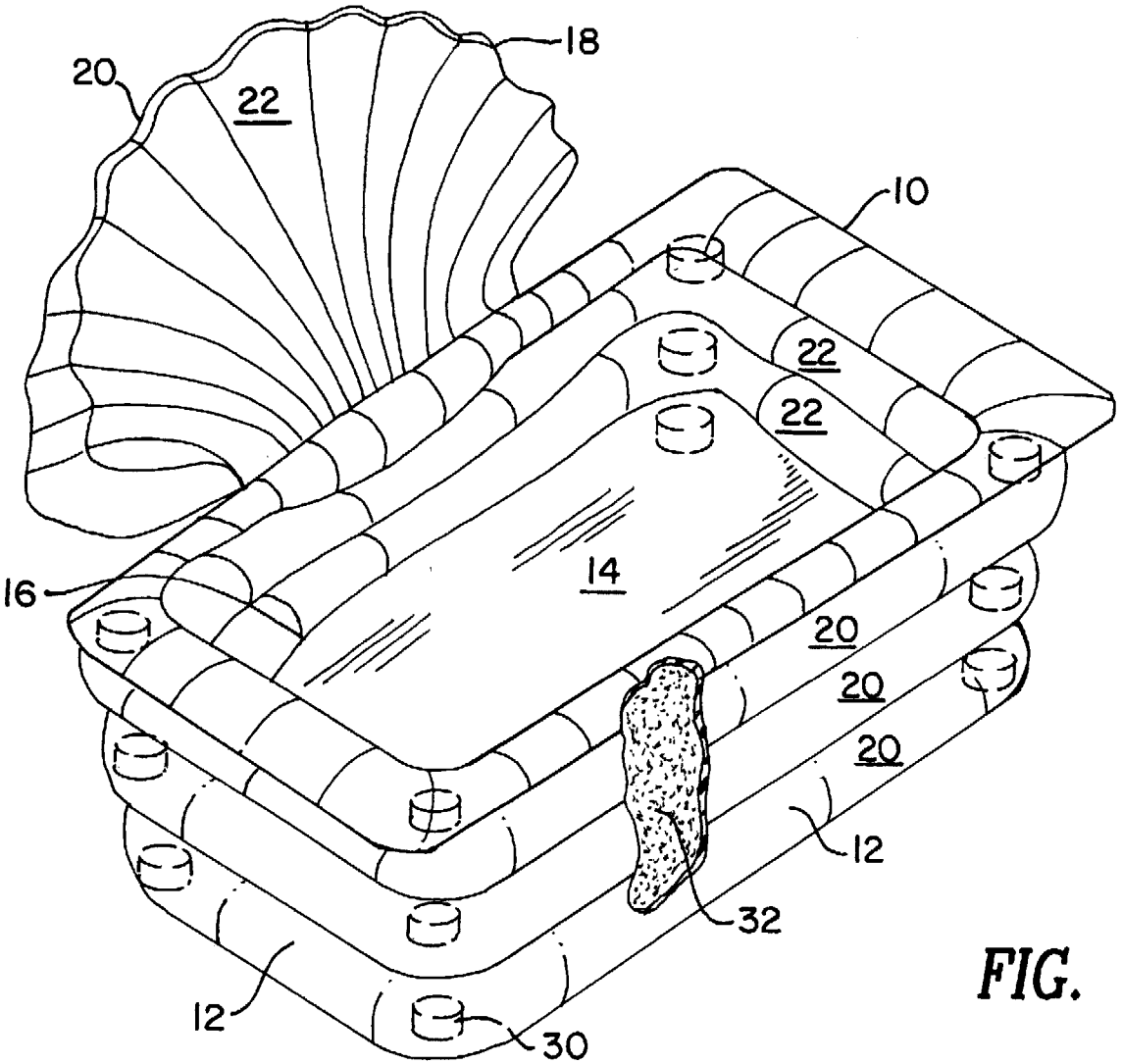
FIG. 1 depicts a perspective view of the preferred embodiment of an infant bathing apparatus with faucet guard.
Figure 2:
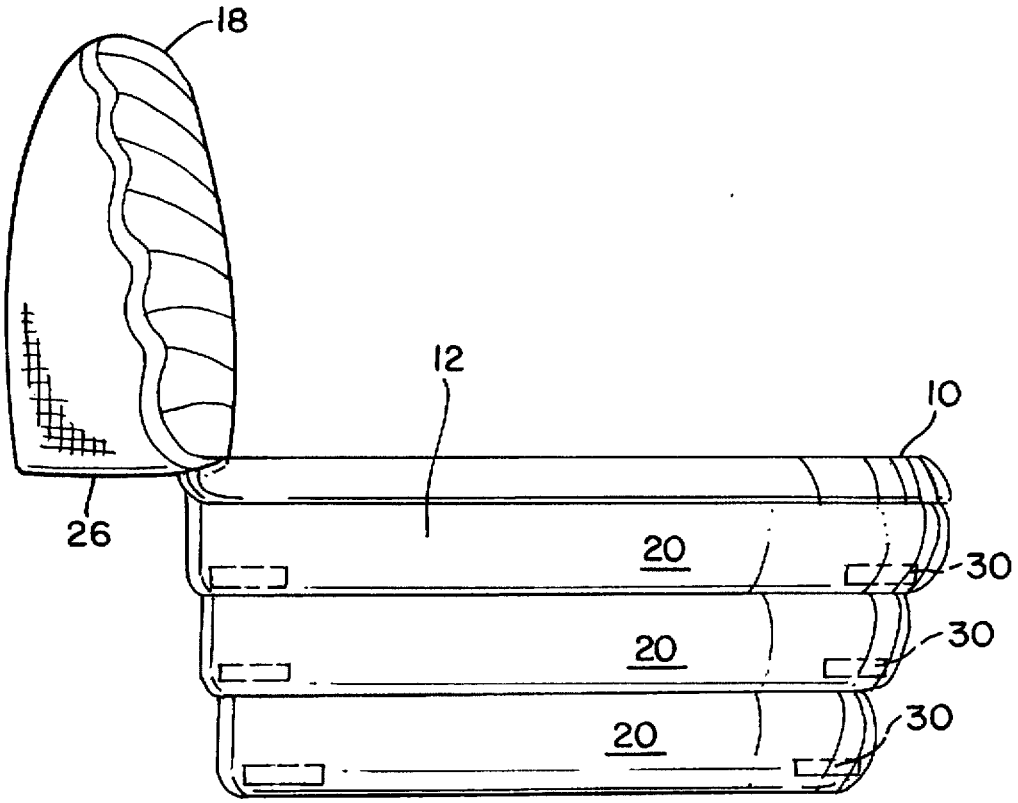
FIG. 2 depicts a side view of the infant bathing apparatus depicted in FIG. 1.

FIGS. 1 and 2 depict the preferred embodiment of the present invention which overcomes the problems typical of the art by providing an infant bathing apparatus with faucet guard. The body 10 may be generally trough shaped having four side walls 12 and a floor 14. While the preferred embodiment includes four side walls 12, it is within the scope of the invention that the body 10 may include three side walls 12, five side walls 12 or more than five side walls 12. Further, while the overall shape of the preferred embodiment is depicted as generally rectangular in shape it is considered within the scope of the invention that the overall shape may be circular, square, triangular, hexagonal or any other desired shape so long as the body 10 defines a cavity 16 surrounded on all sides save one and the cavity is sufficiently large to accept a baby. The bathing apparatus may also include weights and/or magnets 30 disposed within the side walls 12 and/or the floor 14 to help stabilize the tub.

Figure 3:
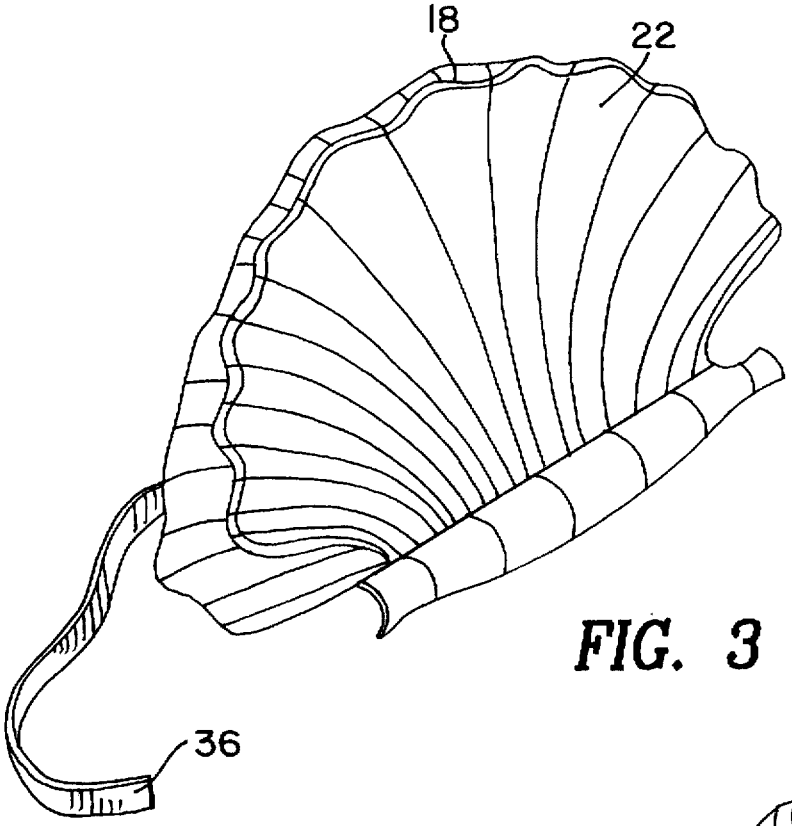
FIG. 3 depicts a perspective view of an alternate embodiment of the faucet guard for use with the infant bathing apparatus depicted in FIG. 1.
Figure 4:
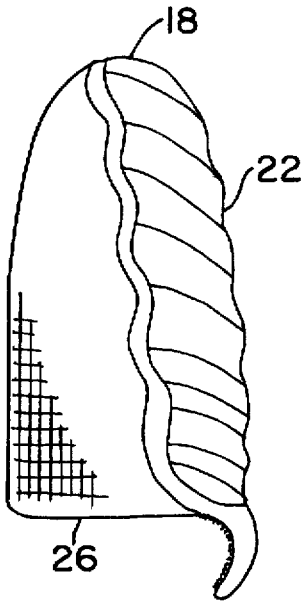
FIG. 4 depicts a side view of the alternate embodiment of the faucet guard for use with the infant bathing apparatus depicted in FIG. 3.
Figure 6:
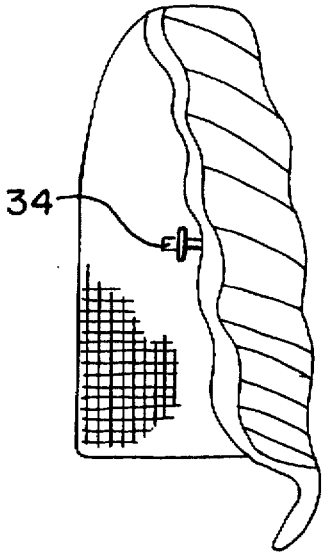
Figure 5:
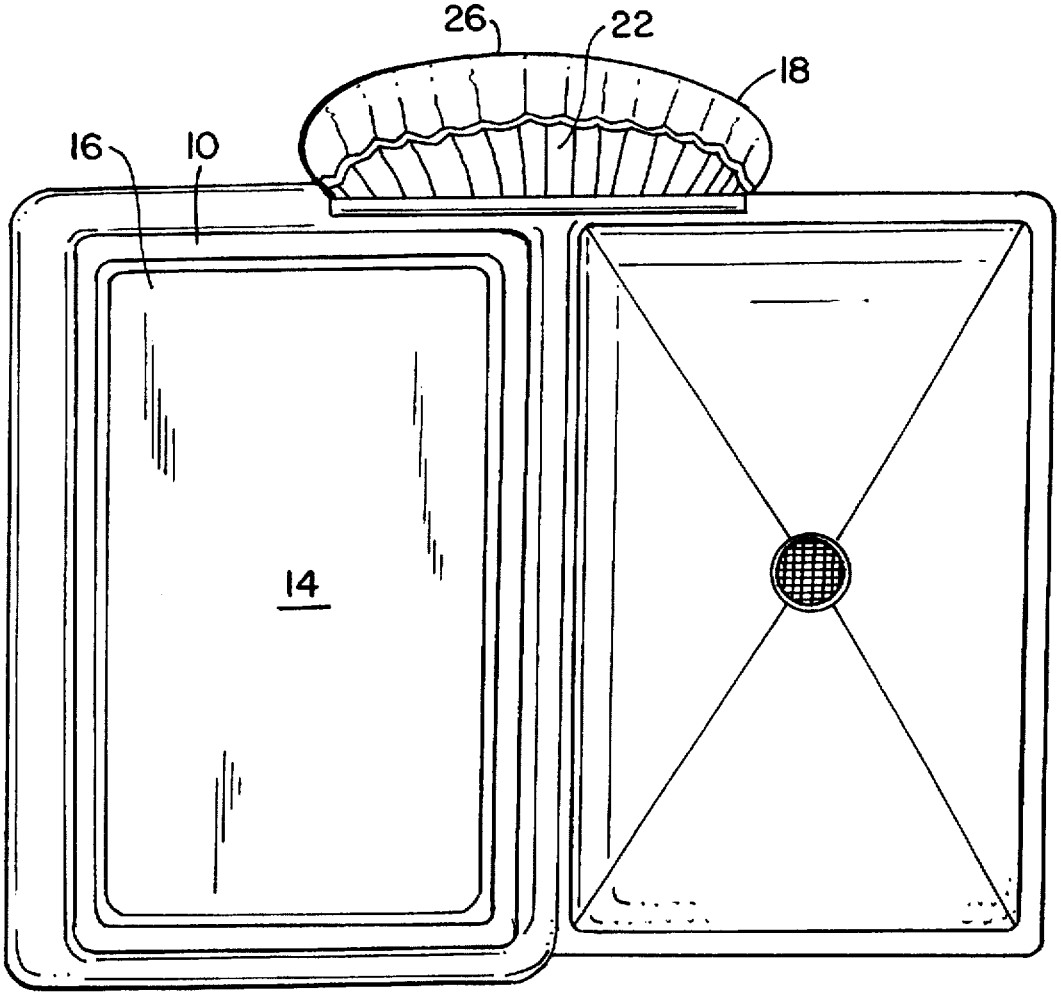
FIG. 5 depicts a top view of the infant bathing apparatus depicted in FIG. 1, as it would be used in a double kitchen sink, with details of the faucet guard unattached from the infant bathing apparatus; and, FIG. 6 depicts a side view of the alternate embodiment of the faucet guard for use with the infant bathing apparatus depicted in FIG. 3 with details of the inflation valve.

The preferred embodiment further includes a faucet guard 18. In the preferred embodiment shown in FIGS. 1 and 2, the faucet guard 18 is generally shell shaped and is connected to the body 10. It is considered within the scope of the invention that the faucet guard may also be any shape such as rectangular, circular, square, triangular, shell shaped (as shown) etc. so long as the faucet guard 18 blocks the faucet and the hot and cold water knobs from the infant. It is further considered within the scope of the present invention that the faucet guard 18 may be permanently attached to the body 10 (as depicted in FIGS. 1 and 2), selectively attachable to the body 10 (as depicted in FIGS. 3 and 4), or separate from the body 10 (as depicted in FIG. 5). Further still, the bathing apparatus may be utilized without the faucet guard 18 altogether.

The bathing apparatus of the present invention is designed to be water permeable and washable to allow for quick drying, thus preventing the buildup of mold, mildew or odor and to keep the bathing apparatus sanitary for the infant. In the preferred embodiment the body 10 and the faucet guard 18 are formed from three layers of material such that the outer layer 20 and the inner layer 22 are formed from the same material. In the preferred embodiment the outer layer 20 and the inner layer 22 are formed from a woven vinyl coated polyester, but other materials such as poly vinyl chloride, rubber or any other material may be used so long as the material is waterproof and washable and the layer of material is water permeable. Further, the inner layer 22 may be formed from a different material than the outer layer 20 again so long as the material for both layers is waterproof and washable and so long as each layer is water permeable. The outer layer 20 and the inner layer 22 may also be formed from the same sheet of material folded over itself.

In the preferred embodiment, the middle layer 32 includes a polyester fiber. This polyester fiber is disposed between the inner layer 22 and the outer layer 20 and forms a cushion to protect the infant from injury. It is considered within the scope of the invention that any other material may be used so long the material is soft, hydrophobic and so long as the layer of material allows water to flow through it.

The faucet guard 18 in the preferred embodiment is made from the same materials as the body; however, the faucet guard 18 may also be inflatable. The faucet guard 18 may be formed from an outer air impervious layer having a periphery, sealed by a periphery seal to an inner air impervious layer having a periphery. The faucet guard 18 may also include a conventional inflation valve 34 disposed within one of the air impervious layers to enable the faucet guard 18 to be selectively inflated. To help the faucet guard 18 remain in place, the faucet guard may include a standard VELCRO™ strap 36 attached to either the inner layer or the outer layer of the faucet guard 18 to wrap around the faucet. It is within the scope of the invention that the strap may be any standard strap. Alternatively, as seen in FIG. 4, the faucet guard 18 may include a pouch 26 for placing over the faucet to hold the faucet guard 18 in place. The pouch 26 may formed by a flexible sheet of material connected on all sides but one at its periphery to one layer of the faucet guard. This will enable the operator to fit the faucet guard 18 over the faucet.

In use, the infant bathing apparatus may be placed in a sink such as a standard kitchen sink or in one half of a double kitchen sink (as shown in FIG. 5) or it can be placed in a tub. If the faucet guard 18 is being used, the faucet guard is placed in front of the faucet or over the faucet as the case may be. To fill the body 10 with water, a person plugs the drain of the sink or bath tub and fills the sink or tub until the water is at the desired level. Because the body 10 is water permeable, as the sink or bath tub fills with water, the body 10 will fill with water. Because the body 10 is water permeable, it can be removed from the sink or bath tub at any time without a hassle and without draining the sink or bath tub. Once the water level has reached the desired level the infant is placed into the body 10 and can be washed. Once the bath is over, the baby can be removed by removing the baby from the body 10. Then the body 10 can be removed from the sink or bath tub either before or after removing the water from the same.

It will thus be seen that the invention efficiently attains the objects set forth above, among those made apparent from the preceding description. In particular, the invention provides an infant bathing apparatus with faucet guard. Those skilled in the art will appreciate that the configurations depicted are distinguishable over the art.

It will be understood that changes may be made in the above construction and in the foregoing sequences of operation without departing from the scope of the invention. It is accordingly intended that all matter contained in the above description or shown in the accompanying drawings be interpreted as illustrative rather than in a limiting sense.

It is also to be understood that the following claims are intended to cover all of the generic and specific features of the invention as described herein, and all statements of the scope of the invention which, as a matter of language, might be said to fall therebetween.

Having described the invention, what is claimed as new and secured by Letters Patent is:

What is claimed is:

1. A generally trough shaped infant bathing apparatus for use in a sink comprising:

a plurality of generally tubular shaped, water permeable, side walls, each of said side walls having a top and a bottom;

a water permeable floor joined to said bottom of each of said plurality of side walls wherein said floor comprises an outer layer and an inner layer each of said layers having a plurality of edges, said outer layer being joined to said inner layer at said plurality of edges; and, a hydrophobic material, disposed between said outer layer and said inner layer and disposed within each of said plurality of side walls, said outer layer, inner layer and hydrophobic material forming water permeable cushions.

2. The infant bathing apparatus as claimed in claim 1 further comprising:

a faucet guard selectively attachable to said top of one of said plurality of side walls.

3. The infant bathing apparatus as claimed in claim 2 wherein said faucet guard comprises a water permeable outer layer sealed to a water permeable inner layer, and a hydrophobic material disposed between said outer layer and said inner layer.

4. A generally trough shaped infant bathing apparatus for use in a sink comprising:

a plurality of generally tubular shaped, water permeable, side walls, each of said side walls having a top and a bottom;

a water permeable floor joined to said bottom of each of said plurality of side walls wherein said floor comprises an outer layer and an inner layer each of said layers having a plurality of edges, said outer layer being joined to said inner layer at said plurality of edges; and, a hydrophobic material, disposed between said outer layer and said inner layer and disposed within each of said plurality of side walls, said outer layer, inner layer and hydrophobic material forming water permeable cushions;

a faucet guard selectively attachable to said top of one of said plurality of side wherein said faucet guard comprises a water permeable outer layer sealed to a water permeable inner layer, and a hydrophobic material disposed between said outer layer and said inner layer; and, said faucet guard further comprises a strap joined to one of said layers for selectively fastening said faucet guard to a faucet.

5. A generally trough shaped infant bathing apparatus for use in a sink comprising:

a plurality of generally tubular shaped, water permeable, side walls, each of said side walls having a top and a bottom;

a water permeable floor joined to said bottom of each of said plurality of side walls wherein said floor comprises an outer layer and an inner layer each of said layers having a plurality of edges, said outer layer being joined to said inner layer at said plurality of edges; and, a hydrophobic material, disposed between said outer layer and said inner layer and disposed within each of said plurality of side walls, said outer layer, inner layer and hydrophobic material forming water permeable cushions;

a faucet guard selectively attachable to said top of one of said plurality of side wherein said faucet guard comprises a water permeable outer layer sealed to a water permeable inner layer, and a hydrophobic material disposed between said outer layer and said inner layer; and, wherein said faucet guard further comprises a flexible sheet having a plurality of sides and a periphery, said flexible sheet being joined at the periphery on all of said plurality of sides except one, to one of said layers, thus enabling said faucet guard to be selectively fitted over a faucet.

6. The infant bathing apparatus as claimed in claim 3 wherein said inner and outer layers comprise woven vinyl coated polyester fiber and said hydrophobic material comprises polyester.

7. A generally trough shaped infant bathing apparatus for use in a sink comprising:

a plurality of generally tubular shaped, water permeable, side walls, each of said side walls having a top and a bottom;

a water permeable floor joined to said bottom of each of said plurality of side walls wherein said floor comprises an outer layer and an inner layer each of said layers having a plurality of edges, said outer layer being joined to said inner layer at said plurality of edges; and, a hydrophobic material, disposed between said outer layer and said inner layer and disposed within each of said plurality of side walls, said outer layer, inner layer and hydrophobic material forming water permeable cushions;

a faucet guard selectively attachable to said top of one of said plurality of side walls; and, wherein said faucet guard comprises an outer air impervious layer having a periphery, an inner air impervious layer having a periphery, said inner and outer layers being joined by periphery seals, and an inflation valve disposed within one of said layers.

8. The infant bathing apparatus as claimed in claim 7 wherein said faucet guard further comprises a strap joined to one of said layers for selectively fastening said faucet guard to a faucet.

9. The infant bathing apparatus as claimed in claim 7 wherein said faucet guard further comprises a flexible sheet having a plurality of sides and a periphery, said flexible sheet being joined at the periphery on all of said plurality of sides except one, to one of said layers, thus enabling said faucet guard to be selectively fitted over a faucet.

10. An infant bathing apparatus comprising:

a cushioned body having a cavity surrounded on all sides except one by said body, said cushioned body comprising a water permeable outer layer sealed to a water permeable inner layer and a hydrophobic material disposed between said outer layer and said inner layer.

11. The infant bathing apparatus as claimed in claim 10 wherein said cushioned body is shaped to conform to a kitchen sink.

12. The infant bathing apparatus as claimed in claim 11 wherein said inner and outer layers comprise woven vinyl coated polyester fiber and said hydrophobic material comprises polyester.

13. The infant bathing apparatus as claimed in claim 11 further comprising:

a faucet guard selectively attachable to said cushioned body.

14. The infant bathing apparatus as claimed in claim 13 wherein said faucet guard comprises a water permeable outer layer sealed to a water permeable inner layer, and a hydrophobic material disposed between said outer layer and said inner layer.

15. An infant bathing apparatus comprising:

a cushioned body having a cavity surrounded on all sides except one by said body, said cushioned body comprising a water permeable outer layer sealed to a water permeable inner layer and a hydrophobic material disposed between said outer layer and said inner layer;

wherein said cushioned body is shaped to conform to a kitchen sink;

a faucet guard selectively attachable to said cushioned body;

wherein said faucet guard comprises a water permeable outer layer sealed to a water permeable inner layer, and a hydrophobic material disposed between said outer layer and said inner layer; and, wherein said faucet guard further comprises a strap joined to one of said layers for selectively fastening said faucet guard to a faucet.

16. An infant bathing apparatus comprising:

a cushioned body having a cavity surrounded on all sides except one by said body, said cushioned body comprising a water permeable outer layer sealed to a water permeable inner layer and a hydrophobic material disposed between said outer layer and said inner layer;

wherein said cushioned body is shaped to conform to a kitchen sink;

a faucet guard selectively attachable to said cushioned body; and, wherein said faucet guard further comprises a flexible sheet having a plurality of sides and a periphery, said flexible sheet being joined at the periphery on all of said plurality of sides except one, to one of said layers, thus enabling said faucet guard to be selectively fitted over a faucet.

17. The infant bathing apparatus as claimed in claim 14 wherein said inner and outer layers comprise woven vinyl coated polyester fiber and said hydrophobic material comprises polyester.

18. An infant bathing apparatus comprising:

a cushioned body having a cavity surrounded on all sides except one by said body, said cushioned body comprising a water permeable outer layer sealed to a water permeable inner layer and a hydrophobic material disposed between said outer layer and said inner layer; and, a plurality of magnets disposed between said inner and outer layers.

19. An infant bathing apparatus comprising:

a cushioned body having a cavity surrounded on all sides except one by said body, said cushioned body comprising a water permeable outer layer sealed to a water permeable inner layer and a hydrophobic material disposed between said outer layer and said inner layer; and, a plurality of weights disposed between said inner and outer layers.

* * * * *